United States Patent [19]

Lyons et al.

[11] Patent Number: 4,936,764

[45] Date of Patent: Jun. 26, 1990

[54] INVERTER FOR BRICK MOULD

[75] Inventors: Nicholas Lyons; George C. Kemp, both of West Sussex, England

[73] Assignee: Redland Bricks Limited, Surrey, England

[21] Appl. No.: 313,067

[22] Filed: Feb. 21, 1989

[30] Foreign Application Priority Data

Mar. 1, 1988 [GB] United Kingdom ..... 8804775

[51] Int. Cl.[5] ..... B28B 5/02

[52] U.S. Cl. ..... 425/439; 198/408; 198/410

[58] Field of Search ..... 425/439, 256, 261; 198/408, 410

[56] References Cited

U.S. PATENT DOCUMENTS

| | | | |
|---|---|---|---|
| Re. 16,424 | 9/1926 | Cary | 425/439 X |
| 2,664,592 | 1/1954 | Ingraham et al. | 425/439 X |
| 2,827,664 | 3/1958 | Ross | 425/439 X |
| 4,108,299 | 8/1978 | Mast, Jr. | 198/408 X |
| 4,505,372 | 3/1985 | Sato | 198/408 X |
| 4,832,173 | 5/1989 | Hattori et al. | 198/410 X |

FOREIGN PATENT DOCUMENTS

| | | | |
|---|---|---|---|
| 700476 | 12/1940 | Fed. Rep. of Germany | 425/439 |
| 259919 | 11/1987 | Japan | 198/410 |
| 657576 | 9/1951 | United Kingdom . | |
| 1213224 | 11/1970 | United Kingdom . | |
| 1254861 | 11/1971 | United Kingdom . | |

*Primary Examiner*—Richard L. Chiesa

*Attorney, Agent, or Firm*—Scherlacher, Mok & Roth

[57] ABSTRACT

An inverter adapted to gently invert multi-cell moulds used in a brick making machine includes a first carrier for transporting a mould through a first arcuate path, a second carrier for transporting a mould through a second arcuate path to cause inversion of the mould, and means for transferring a mould from the first to the second carrier. When the inverter is in use, the cumulative effect of transporting a mould through said first and second arcuate paths is to cause inversion of the mould without subjecting the mould to undue shock loads and to accurately locate the mould for subsequent operations thereon. The first and second carriers preferably include pairs of holders rotating synchronously in opposite directions.

16 Claims, 4 Drawing Sheets

INVERTER FOR BRICK MOULD

BACKGROUND OF THE INVENTION

This invention is concerned with improvements in or relating to an inverter and is particularly although not exclusively concerned with improvements in an inverter adapted for use in the inversion of moulds used in soft mud brick making.

In the manufacture of soft mud bricks, it is conventional to fill a multi-cavity mould with clay at a moulding machine and to discharge the mould cavities by inverting the mould downstream of the moulding machine. Thereafter, the discharged bricks are fed to a drying chamber and subsequently to a conventional kiln or the like for firing and the inverted moulds are recirculated to an input side of the brick moulding machine.

In their passage from a mould discharge locality to the input side of the brick moulding machine, the moulds are cleaned by high pressure water jets and, after partial drying by an air blast or the like, the mould cavities are subjected to a sanding operation whereby the floor and walls of the mould cavities are each provided with a coating of sand.

Before the sanded moulds are fed to the input side of the brick making machine, they are once again inverted so that the cavities thereof are upwardly facing.

In inverting the moulds for effecting the discharge of the soft mud bricks from their cavities, it is advantageous for a certain degree of shock load to be experienced by the mould and its contents because this helps in the release of the "green state" bricks from the moulds.

However, after the mould cavities have been sanded, it is most disadvantageous to subject the moulds to any undue shock loads because the coatings of sand will be lost from the base and side walls of the moulds.

Also, because moulds used in soft mud brick manufacture are generally made of wood, wear is a major problem which may cause difficulties in feed arrangements for transposing the moulds from a downstream side of a moulding machine via an inverter to an input side of the moulding machine.

These difficulties, principally arising from the moulds being of varying sizes, may conveniently be overcome by the use of an inverter provided by the present invention wherein discrepancies in mould sizes are tolerated and transportation of the moulds is effected without undue shock loads thereto.

Many devices have been proposed hitherto for inverting moulds or the like to empty the contents thereof or to orient casks or packages for subsequent operations thereon. Nevertheless, none of the devices known to the applicants hereof are capable of orienting a mould or the like in an exact position for the subsequent operations thereon or for ensuring that such inversion of a mould is effected without undue shock loading thereto. British Specification No. 657576 merely discloses a device for removing loaves of bread from open topped pans in which they are baked and there is no obvious requirement for the loaves to be accurately positioned upon being removed from the pans.

British Specification No. 1213224 and 1254861 each comprise devices for the inversion of kegs or packages and, although each device is comprised of first and second carriers adapted for conveying the kegs or packages through first and second arcuate paths to effect said inversion, there are no means for ensuring the accurate transfer of the kegs or packages between the first and second carriers or for ensuring that the kegs or packages are not subjected to undue shock loads.

SUMMARY OF THE INVENTION

The present invention thus conveniently provides an inverter adapted for use in a brick making machine comprising a first carrier for transporting a mould through a first arcuate path, a second carrier for transporting a mould through a second arcuate path to cause inversion of the mould, characterised in that the inverter further comprises means for transferring a mould from the first to the second carrier whereby, when the inverter is in use, the cumulative effect of transporting a mould through said arcuate paths is to cause inversion of the mould without subjecting the mould to undue shock loads and to accurately locate the mould for subsequent operations thereon.

Preferably, the first and second carriers are mounted for arcuate movement about associated axes.

Conveniently, the first and second carriers are provided on pairs of contra-rotating discs mounted for rotation about said axes.

In the preferred embodiment the contra-rotating discs are provided with mutually intermeshing gears for ensuring, when the inverter is in use, that the pairs of discs are rotated in synchrony one with the other.

In the operation of an inverter provided by the present invention, the first carrier conveniently receives a mould at an infeed position in which infeed position the mould lies on a horizontal axis of said first arcuate path or substantially so and transfers it through said first arcuate path to a transfer position adjacent the second carrier whereat said transfer means is operated to effect the transfer of the mould from the first to the second carrier, said transfer position being conveniently disposed on a common vertical axis of said first and second arcuate paths.

Also, in the operation of the inverter the second carrier conveniently receives a mould from the transfer means at the transfer position and transports it through said second arcuate path to an outfeed position in which outfeed position the mould lies on a horizontal axis of said second arcuate path or substantially so whereby inversion of the mould is achieved as aforesaid.

Preferably, the horizontal axis of said first arcuate path lies below and is parallel or substantially so to the horizontal axis of said second arcuate path.

In a preferred embodiment provided by the invention, there are at least four first and second carriers arranged in associated pairs of first and second carriers and each carrier comprises clamping means for securing the moulds in the carrier.

The present invention thus conveniently provides an inverter adapted for use in receiving an inverted sand coated mold from an infeed conveyor and, after inversion thereof, delivering the mould in a non-inverted condition to an infeed conveyor of a brick making machine in such a manner that the mould is accurately located with respect to the infeed conveyor and is not subjected to undue shock loads whereby the integrity of the sand coating is maintained.

BRIEF DESCRIPTION OF THE DRAWINGS

There now follows, by way of example, a detailed description of a preferred embodiment of an inverter provided by the present invention which description is to be read with reference to the accompanying drawings in which.

DETAILED DESCRIPTION OF THE INVENTION

The inversion of brick making moulds in a soft mud brick making process is usually effected by rotary mechanisms and elevation devices which may be in combination therewith. In such arrangements the moulds are subjected to shock loads which may be most disadvantageous where sand coating of the mould cavities has been effected prior to inversion thereof.

Figure 1:
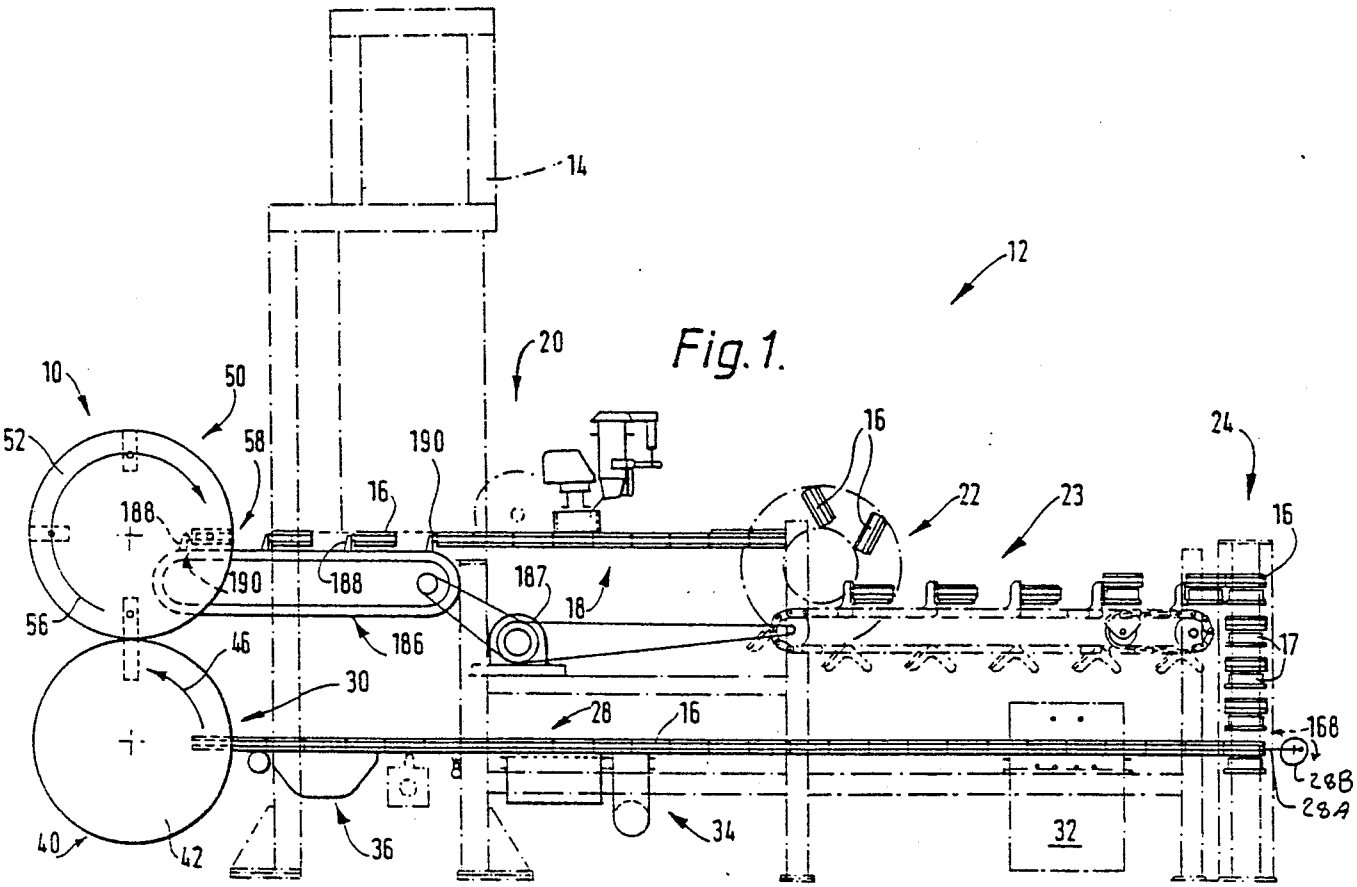
FIG. 1 is a diagrammatic side view of a brick making plant incorporating the inverter of the present invention.

The inverter 10 provided by the present invention seeks to overcome these drawbacks and is thus adapted for use in a brick making plant 12, see FIG. 1, comprising a brick making machine 14 where moulds 16 are filled (by means not shown), an outfeed path 18 on the downstream side 20 of the machine 14 along which path the filled moulds 16 are conveyed firstly to an inversion device 22 and secondly to an associated conveyor 23 prior to discharge of the "green state" bricks 17 from moulds 16 at a discharge position 24, see FIG. 1.

The plant 12 also comprises an infeed conveyor 28 for transporting empty moulds 16 in their inverted condition from the discharge position 24 to an infeed position 30 of the inverter 10, see FIG. 1.

Beneath the infeed conveyor 28 there are provided a mould washing device 32, a mould drying device 34 and a mould sanding device 36 all of conventional design which devices are only indicated in schematic outline in FIG. 1.

Figure 2:
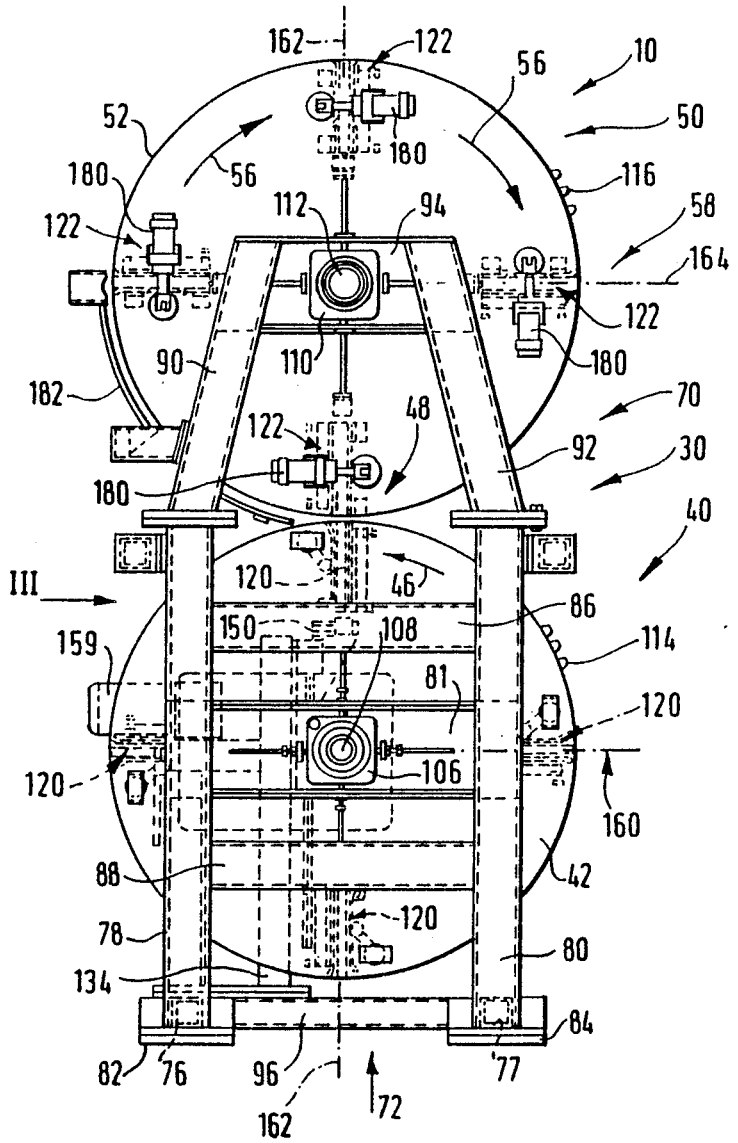
FIG. 2 is a detailed side view of the inverter shown in FIG. 1.

The inverter 10 comprises a first carrier 40 provided by a pair of rotatable discs 42 arranged to receive moulds 16 seriatim from the infeed position 30 and to transport the moulds 16 through a first arcuate path indicated by the arrow 46 in FIGS. 1 and 2 to a transfer position 48, the inverter 10 also comprising a second carrier 50 provided by a pair of rotatable discs 52 arranged to receive moulds 16 seriatim from the first carrier 40 at said transfer position 48 and to transport the moulds 16 through a second arcuate path indicated by the arrows 56 in FIGS. 1 and 2 to an outfeed position 58 of the inverter 10, see FIG. 1.

Figure 3:
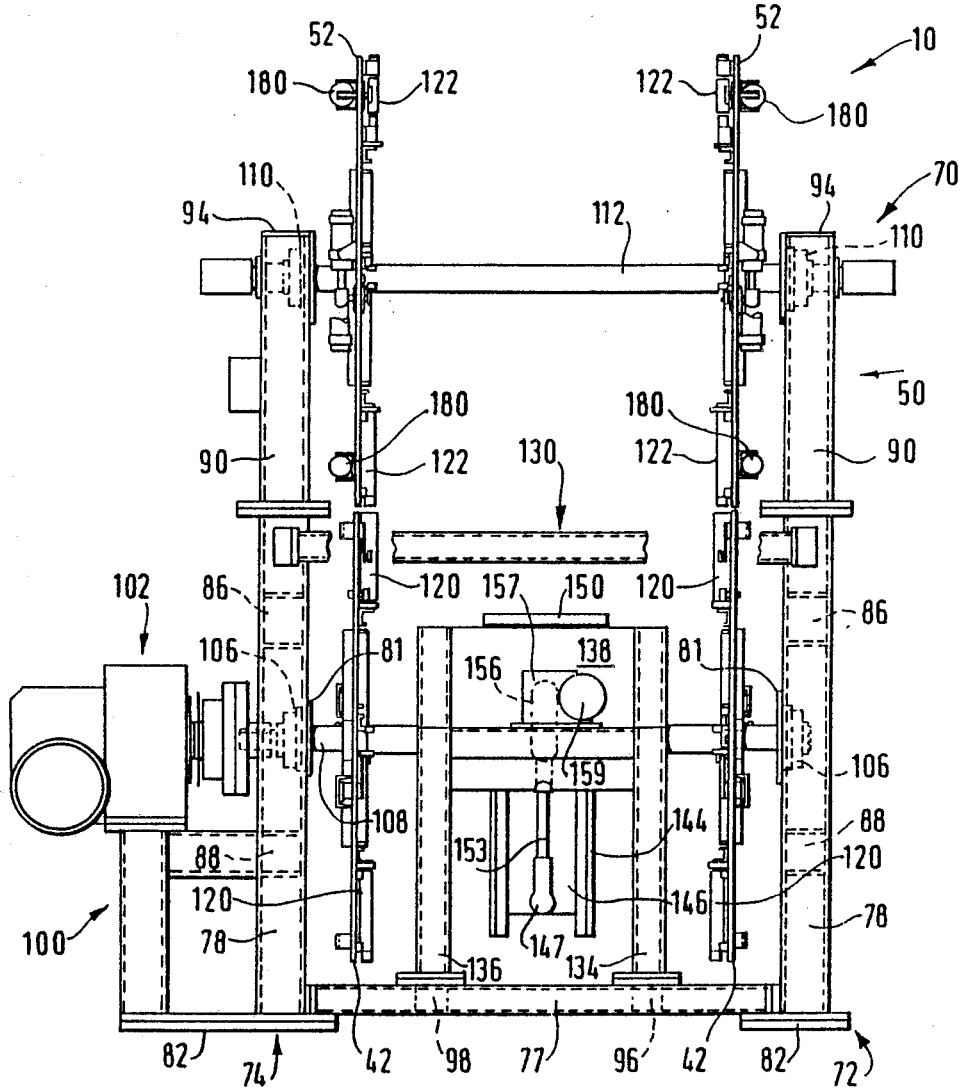
FIG. 3. is a view in the direction of the arrow 3 in FIG. 2.

The inverter 10 comprises a main frame 70 provided by two floor mounted side frames 72 and 74 joined towards their lower ends by two bridging members 76 and 77, see FIGS. 2 and 3.

Figure 4:
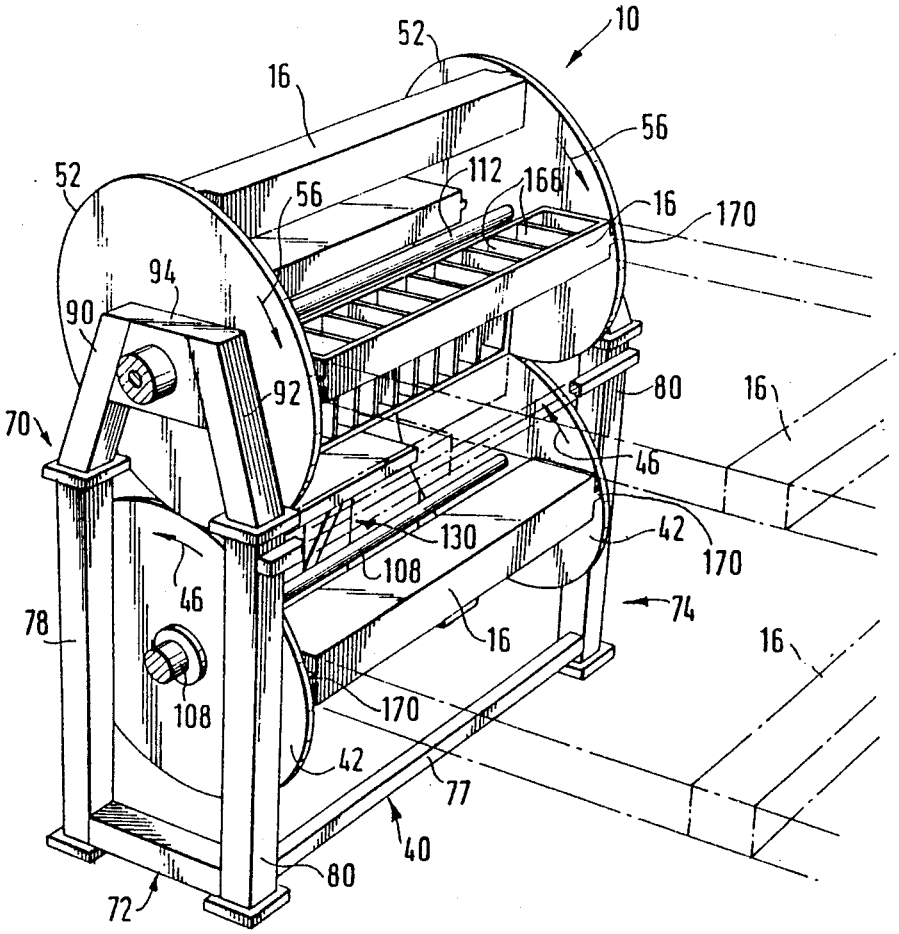
FIG. 4 is a diagrammatic perspective view of the inverter together with infeed and outfeed means for brick making moulds.

The frames 72 and 74 are substantially the same with each comprising, see FIGS. 2, 3 and 4, spaced columns 78 and 80 supported at their lower ends on pads 82 and 84 respectively and bridged towards their upper ends by a member 86 and at mid portions thereof by a member 88, see FIG. 2.

The frames 72 and 74 also comprise inclined portions 90 and 92 extending upwardly from the columns 78 and 80 respectively to be joined by a bridging member 94 at their upper ends, see FIGS. 2 and 4.

Further bridging members 96 and 98 are provided between the members 76 and 77 respectively, see FIGS. 2 and 3.

The pads 82 and 84 extend forwardly of the frame 72, that is to the left viewing FIG. 3, and provide support for a subframe 100 on which is mounted a reduction gearbox and drive means 102 for rotating the discs 42 as described hereinafter.

The columns 78 and 80 also provide support for further bridging elements 81 which in turn provide support for bearing brackets 106. The brackets 106 support a drive shaft 108 connected to the drive means 102. The shaft 108 thus extends between the frames 72 and 74 and carries the pair of rotatable discs 42 in spaced relationship as shown in FIGS. 3 and 4.

The bridging members 94 each provide support for bearings 110 which in turn support a rotatable shaft 112. The shaft 112 thus extends between the frames 72 and 74 and carries the pair of rotatable discs 52 in spaced apart relationship as shown in FIGS. 3 and 4.

The peripheries of the discs 42 and 52 adjacent the frame 72 are each provided with gear teeth 114 and 116 respectively which teeth are arranged in mutual engagement whereby, when the inverter is in use and shaft 108 is rotated by the drive means, rotation of the discs 42 causes corresponding rotation of the discs 52 in an opposite direction, i.e. the discs 42 and 52 are contra-rotating. The discs 42 provide support for four pairs of associated mould clamps !20, see FIGS. 2 and 3, and the discs 52 provide support for four pairs of associated holding mechanisms in the form of mould clamps 122; the purpose and operation of the clamps 120 and 12 will become clear hereinafter.

The inverter 10 further comprises a mould transfer device 130 fixedly mounted on the bridging elements 96 and 98, see FIGS. 2 and 3.

The transfer device 130 comprises two columns 134 and 136, see FIGS. 2 and 3, which provide support for a cross-member 138 on a rearward face of which (viewing FIG. 3) is provided aligned guides (not shown).

The aligned guides engage side rails 144, of a bar 146 mounted for vertical movement beneath the transfer position 48 of the inverter 10. The bar 146 carries a pusher plate 150 at its upper end, see FIGS. 2 and 3, the purpose for which will be made clear hereinafter.

The bar 146 carries a stud 147 on a lower front face thereof, which stud 147 is connected by a link 153 to a crank arm 156, see FIG. 3.

The crank arm 156 is pivotally connected to a motor 159 via a reduction gearbox 157, operation of which motor 159 provides the power to cause vertical movement of the pusher plate 150 when the inverter 10 is in use.

This form of drive for the pusher plate 150 is chosen to produce simple harmonic motion thereby ensuring controlled acceleration and deceleration of the pusher plate 150.

As can be seen in FIG. 2, the four pairs of clamps 120 and 122 are arranged at equispaced intervals about their respective discs 42 and 52.

Thus, two pairs of clamps 120 each lie on a horizontal axis 160 and a common vertical axis 162 respectively of the discs 42 and two pairs of clamps 122 each lie on a horizontal axis 164 and the common vertical axis 162 respectively of the disc 52.

When the brick making plant 12 is in use, the moulds 16 are fed through the machine 14 at a rate of 27 to 30 moulds per minute. Each mould has eight cavities 166.

After the mould cavities are filled, the moulds are fed seriatim by the outfeed conveyor 18 via the inversion device 22 where the moulds 16 are inverted to the discharge position where the mould cavities are emptied. The "green state" bricks 17 are then fed to a kiln car (not shown) and the moulds are transferred by a descending conveyor 168 to the infeed conveyor 28.

As the inverted moulds 16 are fed along the infeed conveyor in "crowded" condition, they pass sequentially over:

(i) the mould washing device 32 where high pressure water jets remove any detritus clinging to the walls and base of the cavities 166;

(ii) the mould drying device 34 where a hot air blast is used to remove droplets of water and to partially dry the moulds; and (iii) the mould sanding device 36 where sand is sprayed onto the walls and base of the cavities, which sand, because the moulds are only partially dried, adheres to the said walls and base.

When the moulds 16 reach the infeed position 30, they are pushed one at a time into the first carrier 42. To enable this, each mould 16 has side flanges 170 which locate between fixed and spring loaded jaws respectively of the clamps 120.

The infeed conveyor 28 is a dead bed conveyor along which the moulds 16 are pushed by a crank arm 28A. The eccentricity of the crank arm 28A is selected such that each rotation of the crank arm shaft advances the moulds 16 along conveyor 28 by a distance equal to the width of a single mould. When conveyor 28 becomes full, each rotation of crank arm 28A forces a mould into carrier 40 at the infeed position for subsequent rotation to the transfer position. The crank arm is rotated by a motor 28B.

With the mould 16 located in the carrier 42 as aforesaid, the drive means 102 is operated to rotate the discs 42 in an anti-clockwise direction viewing FIGS. 1 and 2 to carry the mould 16 from its position coincident with the axis 160 and through the first arcuate path 46 to the transfer position 48 coincident with the common vertical axis 162 whereupon movement of the discs 42 is arrested. The drive means 102 is effective through a reduction gearbox, when the discs are rotated as aforesaid, to ensure that the mould 16 is moved with controlled acceleration and deceleration between controlled positions of dwell in which they are locked against further arcuate movement along said path 46.

The transfer device 130 is then operated to elevate the pusher plate 150 via the piston, cylinder and crank arrangement whereupon the plate 150 engages the mould 16 arrested at the transfer position 48 to push it upwardly viewing FIGS. 2 and 3 from a position between the spring clamps 120 to a position between the juxtaposed clamps 122 of the carrier 50.

The juxtaposed clamps 122 are thereafter operated to securely clamp the moulds in position. To this end, the clamps 122 are provided with fixed and movable jaws respectively with the movable jaw being movable by an associated piston and cylinder arrangement 180.

With the mould 16 clamped in the carrier 50 as aforesaid the drive means 102 is again operated to rotate the discs 52 to carry the mould from the transfer position 48 coincident with the common vertical axis 162 through the second arcuate path 56 to the outfeed position 58 coincident with the axis 164 of the carrier 50 whereupon movement of the discs 52 is arrested. The drive means effects the same control on the mould 16 as it is carried through the second arcuate path 56 that was applied to the mould when it was carried through the first arcuate path 46.

It will be appreciated from FIGS. 1, 2 and 4 that the inverter 10, in transporting moulds 16 seriatim from the infeed position 30 of the carrier 42 to the outfeed position 58 of the carrier 52, will cause the moulds to be rotated through an angle of 180° to present the moulds 16 with the cavities 166 thereof facing upwardly, see FIG. 4.

The inverter 10 also comprises two shield bars 182 (only one of which is shown in FIG. 2) fixedly mounted one on each of the inclined portions 90 of the frames 72 and 74, which bars 182, when the inverter is in use, prevent moulds 16 carried by the carrier 52 from falling out of the clamps 122 should they prove defective, see FIG. 2.

The plant 12 also comprises an outfeed conveyor 186 which is arranged to partially underlie moulds 16 at the outfeed position 58 of the carrier 52. The conveyor 186 is driven by a motor 187 fixedly mounted on a frame of the brick making machine 14 which motor 187 also provides the drive for the conveyor 23 via appropriate chains and drive wheels as indicated in FIG. 1. The conveyor 186 is provided with a series of eight pusher elements 188 which, when the plant is in use with a mould 16 located at the outfeed position 58, sequentially engage one at a time with a trailing edge portion 190 of an associated mould 16 to remove it from the carrier 50 and transport it towards the brick making machine 14.

As stated previously, it is essential that the moulds 16 must not be subjected to undue shock in being transferred from the sanding device 36 adjacent the infeed conveyor 28 to the machine 14 via the inverter 10.

In addition, the disparity between the mould sizes due to differential wear must be allowed for.

The inverter 10 of the present invention overcomes the drawbacks of known inverters and subjects the moulds to minimal shock loads. Also, the inverter is capable of accepting moulds of slightly different sizes and in transferring the moulds as aforesaid ensures, by operation of the transfer device 130, that the trailing edges 190 of the moulds are positioned at a common datum point at the outfeed position 58 so that the pusher elements 188 have a common pick-up and engagement point with respect thereto.

Whereas in the specific embodiment the discs 42 and 52 are arranged to be contra-rotating, in an alternative embodiment provided by the invention the discs may be rotated in the same direction by any suitable gearing or like mechanism.

Also it is envisaged that the carriers 40 and 50 may be provided with more or less than the four pairs of mould clamps 120, e.g. there may be three or six such sets of clamps whereby in use the moulds 16 will be carried through longer or shorter arcuate paths and the transfer of the moulds between the carriers 40 and 50 will be effected at some angular position between the vertical and the horizontal axis of the first carrier 40. In order to facilitate such a modification the carrier 50 will be offset from the vertical axis and will lie on a common transfer axis of the two carriers, e.g. where there are six sets of clamps 120, the common transfer axis will lie at 60° to the horizontal.

However, where there are eight sets of clamps 120, the present arrangement will suffice with the moulds being subjected to at least two indexing steps between being received by the carrier 40 and being transferred to the carrier 50.

While there has been shown and described various arrangements of an inverter for brick moulds, it should be appreciated that the invention is not limited thereto. Accordingly, any modifications, variations or equivalent arrangements within the scope of the accompanying claims should be considered to be within the scope of the invention.

What is claimed is:

1. An inverter for use in a brick making machine comprising a first carrier rotatable about a first generally horizontal axis for transporting a mould through a first arcuate path, a second carrier rotatable abut a second generally horizontal axis for transporting a mould through a second arcuate path to cause inversion of the mould, and means for transferring a mould directly from the first to the second carrier, whereby moulds transported through said arcuate paths are inverted without subjecting the moulds to undue shock loads and are accurately located for subsequent operation thereon.

2. An inverter according to claim 1 wherein the first axis lies beneath and is substantially parallel to the second axis.

3. An inverter according to either one of claims 1 or 2 wherein the first and second carriers are provided on pairs of contra-rotating discs.

4. An inverter according to claim 3 wherein the contra-rotating discs are mounted for rotation about the first and second axes.

5. An inverter according to claim 4 wherein the contra-rotating discs are provided with mutually intermeshing gears for ensuring, when the inverter is in use, that the pairs of discs are rotated in synchrony one with the other.

6. An inverter according to claim 1 or 2 wherein in use the first carrier receives a mould at an infeed position in which infeed position the mould lies substantially on a horizontal axis of said first arcuate path and transfers the received mould through said first arcuate path to a transfer position adjacent the second carrier whereat said transfer means is operated to effect the direct transfer of the mould from the first to the second carrier wherein said transfer position is disposed on a common axis of said first and second arcuate paths.

7. An inverter according to claim 6 wherein in use the second carrier receives a mould from the transfer means at the transfer position and transports it through said second arcuate path to an outfeed position in which outfeed position the mould lies substantially on a horizontal axis of said second arcuate path whereby inversion of the mould is achieved as aforesaid.

8. An inverter according to claim 7 wherein the horizontal axis of said first arcuate path lies below and is substantially parallel to the horizontal axis of said second arcuate path.

9. An inverter according to claim 1 or 2 comprising a plurality of clamping means for securing the moulds on the first and second carriers.

10. An inverter according to claim 1 or 2 for use in receiving an inverted sand coated mould from an infeed conveyor and, after inversion thereof delivering the mould in an uninverted condition to an infeed conveyor of a brick making machine in such a manner that the mould is accurately located with respect to the infeed conveyor and is not subjected to undue shock loads whereby the integrity of the sand coating is maintained.

11. An inverter for gently inverting brick making moulds comprising:

a first carrier transporting a mould received in a predetermined orientation at an infeed position through a first arcuate path to a generally horizontal transfer position;

a second carrier disposed to receive a mould directly from the first carrier at the transfer position and transfer the mould through a second arcuate path to an outfeed position, the second arcuate path causing inversion of the mould relative to the predetermined orientation; and a transfer device coupled to transfer a mould directly from the transfer position of the first carrier to the second carrier.

12. An inverter for gently inverting brick making moulds, the inverter comprising:

a first carrier disposed for rotation about a first axis and having a pair of spaced apart holding mechanisms disposed to receive and retain opposite ends of a mould having a predetermined orientation at an infeed position, the pair of holding mechanisms rotating to a transfer position upon receiving a mould;

a second carrier disposed for rotation about a second axis spaced apart from the first axis and having a pair of spaced apart holding mechanisms disposed to receive and retain opposite ends of a mould at the transfer position, the pair of holding mechanisms rotating to an outfeed position upon receiving a mould, the rotation to the outfeed position causing inversion of the mould relative to the predetermined orientation; and a transfer device coupled to transfer a mould from the pair of holding mechanisms of the first carrier directly to the pair of holding mechanisms of the second carrier at the transfer position.

13. An inverter according to claim 12 wherein the first carrier has a plurality of pairs of holding mechanisms rotationally spaced about the first axis such that whenever a given pair of holding mechanisms is positioned at the infeed position a different pair of holding mechanisms is positioned at the transfer position and the second carrier has a plurality of pairs of holding mechanisms such that whenever a given pair of holding mechanisms is positioned at the transfer position a different pair of holding mechanisms is positioned at the outfeed position.

14. An inverter according to claim 13 further comprising an interlock mechanism synchronously interlocking the first and second carriers to produce synchronous rotation thereof in opposite directions.

15. An inverter according to claim 14 wherein each mould has a pair of end flanges disposed on opposite ends thereof and each holding mechanism comprises a clamp disposed to slidingly receive and retain an end flange.

16. An inverter according to claim 13 further comprising a motor coupled to rotationally drive the first and second carriers with acceleration and deceleration which is controlled to avoid imparting a shock to any mould being transported by the inverter.

* * * * *